United States Patent [19]

Wright

[11] 4,098,210

[45] Jul. 4, 1978

[54] CANVASWORKING METHOD AND ARTICLE

[76] Inventor: V. Gene Wright, 2349 Garfield Dr. S., Indianapolis, Ind. 46203

[21] Appl. No.: 769,963

[22] Filed: Feb. 18, 1977

[51] Int. Cl.[2] ..... D05C 3/00

[52] U.S. Cl. ..... 112/439; 112/266

[58] Field of Search ..... 112/439, 402, 404, 266

[56] References Cited

FOREIGN PATENT DOCUMENTS

| | | | |
|---|---|---|---|
| 921,760 | 1/1947 | France | 112/402 |
| 1,550,147 | 11/1968 | France | 112/439 |
| 420,210 | 10/1925 | Fed. Rep. of Germany | 112/439 |
| 14,415 | 6/1897 | Switzerland | 112/439 |
| 235,114 | 6/1925 | United Kingdom | 112/402 |

*Primary Examiner*—Alfred R. Guest

*Attorney, Agent, or Firm*—Woodard, Weikart, Emhardt & Naughton

[57] ABSTRACT

A canvasworking method is disclosed herein which comprises a procedure by which the entire surface of an open weave material is covered. The method entails the formation of several endways-adjacent stitches in a line along the top of the open weave material, and several endways-adjacent stitches in a line along the bottom of the open weave material and directly underlying the top stitches. The top and bottom stitches each extend between first and second holes in the open weave material. The first and second holes of at least two of the top stitches and of the bottom stitches include at least one hole in the open weave material lying therebetween, such that the stitches extend more than just between adjacent holes. The method is preferably performed by first weaving a strand of material through an open weave material in a first direction forming a line of alternately top and bottom stitches. The strand is then returned through the open weave material in the opposite direction, forming the remaining top and bottom stitches for the line. Many variations of the basic canvaswork method are possible, and the method may be used in conjunction with other canvasworking techniques.

15 Claims, 7 Drawing Figures

CANVASWORKING METHOD AND ARTICLE

BACKGROUND OF THE INVENTION

1. Field of the Invention

This invention relates to the field of canvasworking techniques and articles, and more particularly to a simple, yet versatile, method for entirely covering an open weave material.

2. Description of the Prior Art

A variety of canvasworking techniques are well known as methods for creating artistic works. In the long history of this artistic field, a few basic types of canvasworking have been developed and endured. Embroidery, for example, is a traditional method for producing a pattern upon a cloth material. Crewel is a similar process by which patterns are produced upon a cloth backing, crewel differing from embroidery primarily in the use of heavier yarns to produce filled-in areas of the pattern. Canvaswork on the other hand is a process by which the entire surface of a work piece is covered, thereby creating a background as well as a pattern on the finished work.

One of the most well known forms of canvaswork is conventional needlepoint. In this method the stitches are applied diagonally on the canvas. The most basic stitch used in conventional needlepoint is the tent stitch in which the junction between one warp thread and one woof thread is covered diagonally by the strand of material being used to cover the open weave background. The tent stitch is repeated successively with adjacent junctions of warp and woof threads working from the bottom left hole to the upper right hole until the entire work piece is completed. This technique has several desirable features which have made this canvasworking method such a popular one. Because of the small stitches, the designs which may be produced are many.

Further, the finished work is relatively hard and wears very well so that the product may be used for heavy use applications such as on chair seats or foot stools. It is also well known, however, that there are several disadvantages in performing conventional needlepoint. Perhaps the most notable disadvantage is that this method is a very slow, laborious and tedious procedure which requires considerable concentration and potential eye strain. Further, although the procedure is versatile with respect to the types of designs which may be reproduced, the borders between different colors in the work are rather prominent and a hard-edge effect results. Also, curves and straight diagonal lines produced in certain areas of the work appear jagged. Finally, in performing this technique the open weave canvas material may become quite distorted, and the finished work correspondingly loses some of its attractiveness.

A contrasting canvasworking technique is known as bargello and differs in part from conventional needlepoint in that the process is more quickly performed. In bargello the stitches are upright on the canvas and are worked in stitch patterns such as those known by the terms Florentine, Byzantine, Hungarian Point, and Flame Stitch. For each stitch pattern a uniform stitch length is used. These stitches are applied to the open weave canvas by extending between parallel and adjacent warp threads or woof threads, the stitches thereby covering only the woof threads or the warp threads, respectively. The stitches used in bargello typically extend over between two and nine warp or woof threads, but the number of threads covered by a single stitch is always uniform for a given work. In some designs, stitches extending over six threads, for example, may be combined with stitches extending over two threads, for example, but once the pattern is established it does not vary for that work piece. As a result, the designs which may be reproduced by bargello are limited, and usually are based upon geometric patterns having one or two line repeating patterns. Bargello does have the advantages of being faster and producing less canvas distortion than in conventional needlepoint, and the finished product does wear well. The primary limitations, however, are in the facts that the types of designs which may be reproduced by bargello are limited, and the stitches must be uniform in length and therefore counted throughout the work piece.

Although a variety of canvasworking techniques, such as conventional needlepoint and bargello, have been in existence for a considerable time, a canvasworking method which combines the design versatility of conventional needlepoint and the speed of bargello has not heretofore been devised. The method of the present invention provides both of these advantages in a single canvasworking technique, and therefore, satisfies this longstanding need.

Various forms of canvasworking are the subject of issued U.S. patents. In U.S. Pat. No. 1,869,386, issued to Marzak on Aug. 2, 1932, there is disclosed a specific embroidery stitch which is applied to a cloth base. The method for making simulated needlepoint embroidery is disclosed in U.S. Pat. No. 3,240,176, issued to Morrison on Mar. 15, 1966. In U.S. Pat. No. 3,040,332, issued to Kleinwald on June 26, 1962, there is disclosed an embroidery technique which is intended to produce a three dimensional effect in the finished article. A method for mechanically reproducing embroidery articles is disclosed in U.S. Pat. No. 1,791,599, issued to Moevus et al. on Feb. 10, 1932. A method of producing an ornamental work by applying thread or yarn to a rigid or semi-rigid, mesh is disclosed in U.S. Pat. No. 1,333,687, issued to Strasburger on Mar. 16, 1920.

SUMMARY OF THE INVENTION

One embodiment of the present invention is a method of canvasworking an area of an open weave material defining several holes and having a first, top surface and a second, bottom surface comprising the steps of making several endways-adjacent top stitches in a line along the first surface of the open weave material, each of the top stitches extending from a first hole in the open weave material to a second hole in the open weave material, the first and second holes of at least two of the stitches having at least one hole in the open weave material lying therebetween, making several endways-adjacent bottom stitches in a line along the second surface of the open weave material, the line of bottom stitches directly underlying the line of top stitches, each of the bottom stitches extending from a first hole in the open weave material to a second hole in the open weave material, the first and second holes of at least two of the stitches having at least one hole in the open weave material lying therebetween, and repeating the above steps to produce a plurality of lines of top and bottom stitches along the first and second surfaces of the open weave material.

It is an object of the presnt invention to provide a canvasworking technique which combines versatility of design and speed of performance.

Another object of the present invention is to provide a canvasworking method which results in only minimal distortion of the supporting open weave canvas.

A further object of the present invention is to provide a canvasworking method which can be used to produce either hard or soft edges at the borders of different colors.

It is another object of the present invention to provide a canvasworking method which has the visual appearance of weaving.

It is a further object of the present invention to provide a canvaswork product which wears well, and which includes stitches which interlock with each other around the supporting open weave material to reduce the tendency for snags.

Another object of the present invention is to provide a canvaswork article in which curves reproduced in the article are smooth in appearance in all areas of the work, and in which padding of the product by the inclusion of stitches on the top and bottom of the supporting material is achieved.

It is a further object of the present invention to provide a canvasworking technique and article which meet the above objectives and which may have many variations and can be used in conjunction with other canvasworking techniques.

Further objects and advantages of the present invention will become apparent from the description of the preferred embodiments which follows.

DESCRIPTION OF THE PREFERRED EMBODIMENTS

Figure 1:
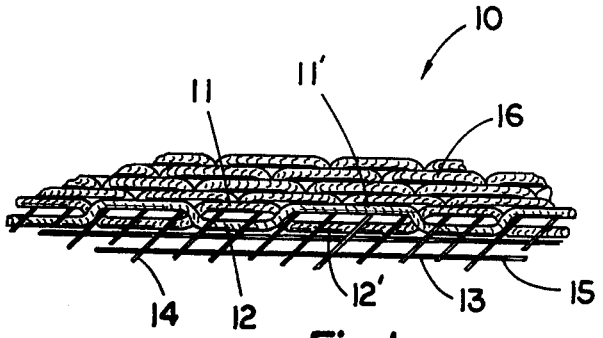
FIG. 1 is a perspective view of a portion of an article produced in accordance with the canvasworking method of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As previously discussed, canvasworking in a variety of forms has existed for a long time, and provides a method for producing a design or pattern upon a backing material. Many forms of canvasworking are directed at forming a pattern upon a cloth material which also forms a part of the visible end product. Other forms of canvasworking employ an open weave material which is entirely covered by the material used to provide the design. The present invention relates to a method and article of the latter type, and provides a simple, quick, and versatile canvasworking technique. The various embodiments of the method and article of the present invention safisfy the objectives and purposes previously detailed.

Figure 2:
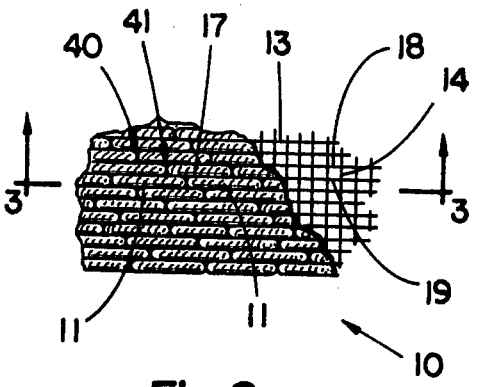
FIG. 2 is a top view of the article portion of FIG. 1 and shows a number of lines of top stitches provided in accordance with the present invention.
Figure 3:
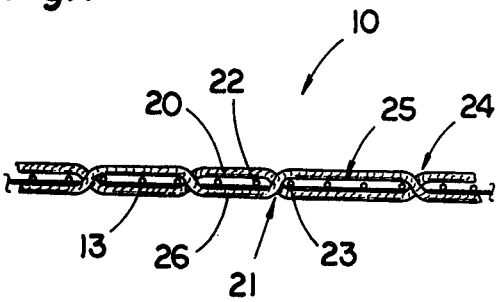
FIG. 3 is a side, cross-sectional view taken along the line 3—3 in FIG. 2 in the direction of the arrows.

Referring now in particular to FIGS. 1–3, there is shown a canvaswork article 10 produced in accordance with the present invention. Article 10 includes a series of endways-adjacent top stitches, such as 11 and 16, and bottom stitches, such as 12, supported upon an open weave material 13. The top stitches are formed in a plurality of lines, such as the one containing top stitches 11 and 11'. A corresponding line of bottom stitches, such as that containing stitches 12 and 12', directly underlies each of the corresponding line of top stitches. As is apparent from FIGS. 1 and 2, the plurality of lines of top stitches entirely covers the open weave material 13 to produce the visible surface of the canvaswork article 10.

Open weave material 13 may comprise any suitable material, and typically would comprise a woven canvas having a rectangular array of warp threads, such as 14, and woof threads, such as 15, as is known in the art. A given line of top and bottom stitches preferably extends between parallel, adjacent warp threads or woof threads. The lines of stitches are shown in FIGS. 1–3 to extend between adjacent woof threads, although the article could be equally well produced by extending the lines of stitches between adjacent warp threads, or by the less preferable method of extending the lines of stitches diagonally or in a non-straight fashion. In particular, the extension of the lines of stitches between parallel threads of the open weave material 13 is exemplified by top stitch 17 (FIG. 2) which extends between adjacent woof threads 18 and 19.

The exact length and position of each of the stitches will vary in accordance with the particular design or effect to be achieved. It is generally preferred that the ends of the stitches, such as the ends 40 and 41 (FIG. 2), not be immediately adjacent for adjacent lines of stitches. This preference is due to the fact that the coincidence of the ends of stitches in adjacent lines would create a line effect which may be undesirable in the pattern being produced. There are, however, instances in which the line would want to be intentionally formed if the appearance is appropriate in the overall design. As is more apparent from the description below, the ends, such as 40 and 41, of the stitches in a line correspond to holes in the open weave material 13 to which the strand of material forming the stitches is threaded from an opposite side or surface of the open weave material 13.

Referring now in particular to FIG. 3, the method for forming the top and bottom stitches is more particularly shown. Top stitch 20 is formed from a strand of suitable material, such as a thread or yarn of the type commonly used in canvaswork. Stitch 20 extends from a first hole 21, defined by adjacent warp threads 22 and 23 and the adjacent woof threads between which the line of stitches is extended, to a second hole 24 which is similarly defined by the threads of the open weave material 13. In accordance with the method of the present invention, several top stitches, such as 20, are formed in a line along the top surface of material 13. For at least two of the top stitches in a line, the first and second holes, 21 and 24 respectively, have at least one hole, such as 25, in the open weave material lying therebetween.

Also shown in FIG. 3 is the preferred embodiment of the present invention in which the bottom stitches directly underlie the top stitches, such that the first and second holes between which top stitch 20 extends are identical with the first and second holes between which bottom stitch 26 extends.

Figure 4:
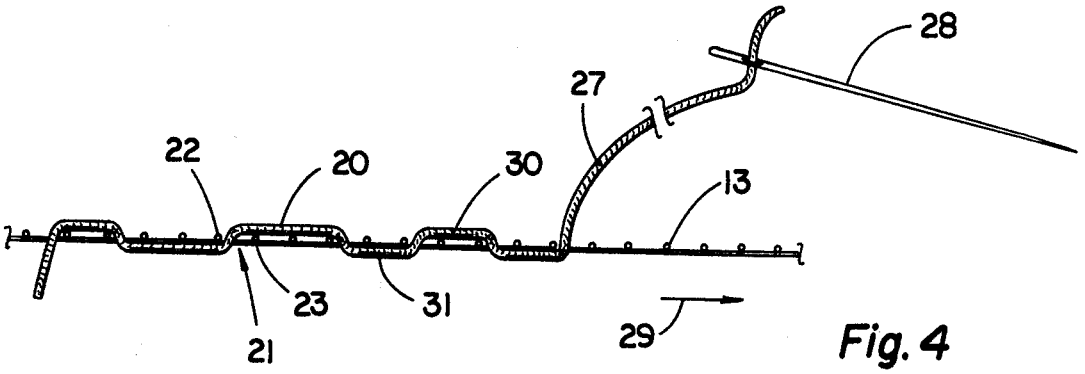
FIG. 4 is a side, cross-sectional view of an open weave material with a strand of material woven thereon in accordance with a first step of one embodiment of the method of the present invention.
Figure 5:
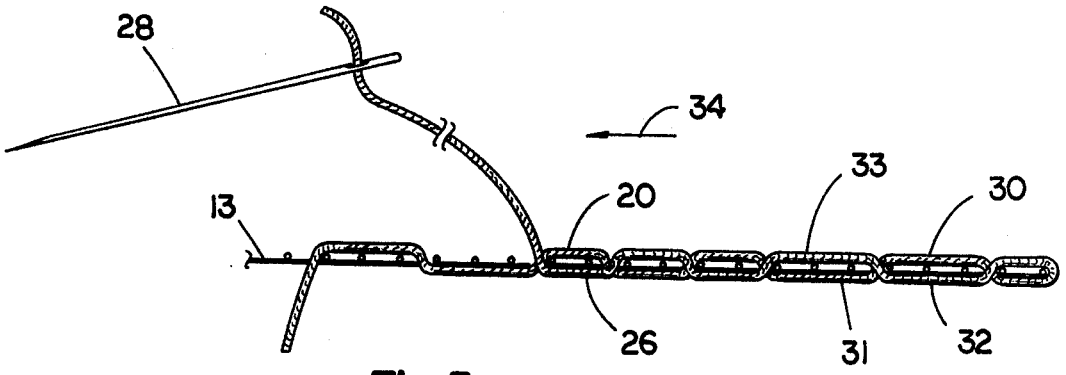
FIG. 5 is a side, cross-sectional view identical with FIG. 4, except that the strand of material is additionally shown woven onto the open weave material in a reverse direction in accordance with a second step of one embodiment of the present invention.

The method of the present invention may be performed by a variety of combinations of steps. In its broadest sense, the method comprises the formation of several endways-adjacent top stitches in a line along the top surface of the material 13. It will be appreciated that this effect may be accomplished by a variety of stitching techniques, although certain methods are preferred. Generally, it is preferable to form the stitches by first weaving a strand of material in a line along the open weave material to produce a "run" of alternating top and bottom stitches as shown in FIG. 4. In doing so, a first top stitch 20 is formed and a second top stitch 30 is formed at a position spaced apart from first top stitch 20. As is apparent from FIG. 4, the top stitches in a run need not be of the same length, and it is in fact preferred that the stitches in a run be of differing lengths. The continuous strand of material 27 forms top stitches 20 and 30 and extends therebetween along the bottom side of material 13 to form a first bottom stitch 31. The weaving of the strand 27 is then repeated to provide the missing top and bottom strands. A variation of this method would be to do the second weaving or run with a different color, or to use several colors for a given line of stitches. The second weaving may be performed in either direction, but preferably is performed by weaving the strand 27 in the opposite direction from the end of the line of stitches as is shown in FIG. 5. Thus, the preferable method of the present invention is to weave the strand of material 27 in a first direction 29, (FIG. 4) and to then at the end of the line of stitches reverse the weaving and produce the remaining stitches of the line while moving in the direction of arrow 34 (FIG. 5). Any suitable implement, such as a needle 28, may be used to facilitate the weaving of the strand 27 through the holes in material 13.

Figure 6:
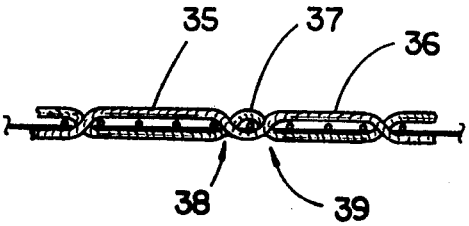
FIG. 6 is a side, cross-sectional view of a portion of a canvaswork article exemplifying an alternate embodiment of the method and article of the present invention.

An alternate embodiment of the method and article of the present invention is shown in FIG. 6. In this embodiment, at least one of the top stitches extends between adjacent holes, rather than between holes which are spaced apart by additional holes lying therebetween. Thus, top stitches 35 and 36 extend between holes which are spaced apart by additional holes as previously described. Top stitch 37, however, extends between adjacent holes 38 and 39, and a different visual effect is produced. Again, a variety of steps may be employed to produce the stitch work shown in FIG. 6. It is preferred, however, that the stitches be formed by first weaving the strand of material to form alternating top and bottom stitches, and thereafter weaving the strand of material to form the remainder of the stitches in the line.

Figure 7:
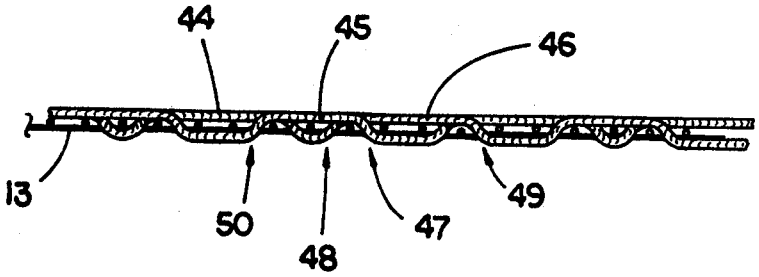
FIG. 7 is a side, cross-sectional view of a canvaswork article exemplifying a third embodiment of the method and article of the present invention.

A third embodiment of the method and article of the present invention is depicted in FIG. 7. This embodiment differs from the prior two in that the bottom stitches in a given line are not endways-adjacent. The stitch of the third embodiment is characterized in that at least one of the first and second holes between which a top stitch extends lies between the first and second holes between which an adjacent top stitch extends. Thus, top stitch 45 extends between first hole 47 and second hole 50. First hole 47 lies between first and second holes 48 and 49 between which extends adjacent top stitch 46. In accordance with this embodiment of the present invention, the entire top surface of the open weave material is covered by stitches, but the stitches in a line overlap. By forming the stitches in accordance with this third embodiment of the present invention, the ends of the top stitches are not as apparent since they lie within the adjacent stitches. The canvaswork is performed preferably in the same manner as previously described. For example, the strand of material forming top stitches 44 and 46 is woven through open weave material 13 to position the stitches as desired. Similarly, the strand of material forming top stitch 45 is preferably woven through the open weave material 13 to position the stitches as desired.

Many advantages are realized by producing an article in accordance with the method of the present invention. The method described is capable of producing a variety of designs and may be quickly performed. The lines of stitches may extend vertically, horizontally or diagonally, and even in a non-straight fashion. The distortion of the open weave material upon which the canvaswork is performed is minimal and the method of applying the yarn to the open weave material interlock the stitches to reduce the tendency for snagging. The borders between differing colors may be made to appear either sharply defined or gradually changing, and the visual appearance of the article is closer to weaving than it is to needlepoint. The article will wear well, and the formation of stitches on both the top and bottom surfaces of the open weave material produces a padding effect.

The materials used to perform the method of the present invention will vary with the desired effect and intended use of the finished article. The open weave material may comprise any suitable type, with a canvas material being one which is frequently used. For the purposes of the present invention the term "open weave material" is used to mean a material having clearly defined openings between adjacent strands forming the material. The number of threads over which the individual stitches should extend will vary with the size of the weave of the material and the color area to be covered. For example, for a 12 or 14 point canvas it is preferable to extend an individual stitch for not more than about seven or eight canvas threads, with stitches extending for between four and six threads being preferred. The strands used to perform the work may be of any suitable material such as yarn, threads, metallic materials and a variety of others. The method of the present invention may be used in conjunction with other canvasworking or rug-making techniques.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of canvasworking an area of an open weave material defining many holes and having a first, top surface and a second, bottom surface comprising the steps of:

a. making several endways-adjacent top stitches in a line along the first surface of the open weave material, each of the top stitches extending from a first hole in the open weave material to a second hole in the open weave material, the first and second holes of at least two of the top stitches having at least one hole in the open weave material lying therebetween;

b. making several endways-adjacent bottom stitches in a line along the second surface of the open weave material, the line of bottom stitches directly underlying the line of top stitches, each of the bottom stitches extending from a first hole in the open weave material to a second hole in the open weave material, the first and second holes of at least two of the bottom stitches having at least one hole in the open weave material lying therebetween and;

c. repeating steps (a) and (b) to produce a plurality of lines of top and bottom stitches along the first and second surfaces of the open weave material.

2. The method of claim 1 in which the making of steps (a) and (b) of the top and bottom stitches is performed by the following steps:

d. forming a first of the top stitches from a strand of material;

e. after step (d), forming a second of the top stitches from a strand of material, the second top stitch being spaced apart from the first top stitch, the strand forming the first top stitch being continuous with the strand forming the second top stitch and extending between the first and second top stitches along the second surface of the open weave material to form a first of the bottom stitches;

f. after step (e), forming a second of the bottom stitches, the second bottom stitch directly underlying one of the first and second top stitches;

g. after steps (f), forming a third of the top stitches from a strand of material, the third top stitch directly overlying the first bottom stitch; and h. after step (g), forming a third of the bottom stitches, the third bottom stitch directly underlying the one of the first and second top stitches different from the one which the second bottom stitch underlies, a continuous strand of material consecutively forming the second bottom stitch, third top stitch, and third bottom stitch.

3. The method of claim 1 in which the open weave material comprises a rectangular array of a warp and a woof, the warp and woof each comprising several parallel threads.

4. The method of claim 3 in which each of the bottom stitches directly underlies a respective one of the top stitches, the holes between which extends a top stitch being identical with the holes between which extends the respective bottom stitch.

5. The method of claim 4 in which the making of steps (a) and (b) of the top and bottom stitches is performed by the following steps:

d. forming a first of the top stitches from a strand of material;

e. after step (d), forming a second of the top stitches from a strand of material, the second top stitch being spaced apart from the frist top stitch, the strand forming the first top stitch being continuous with the strand forming the second top stitch and extending between the first and second top stitches along the second surface of the open weave material to form a first of the bottom stitches;

f. after step (e), forming a second of the bottom stitches, the second bottom stitch directly underlying one of the first and second top stitches;

g. after step (f), forming a third of the top stitches from a strand of material, the third top stitch directly overlying the first bottom stitch; and h. after step (g), forming a third of the bottom stitches, the third bottom stitch directly underlying the one of the first and second top stitches different from the one which the second bottom stitch underlies, a continuous strand of material consecutively forming the second bottom stitch, third top stitch, and third bottom stitch.

6. The method of claim 5 in which steps (d) and (e) comprise weaving a strand of material through holes in the open weave material in a first direction, steps (f) through (h) comprising weaving the strand of material through the holes in a second direction opposite the first direction, whereby the second bottom stitch underlies the second top stitch and the third bottom stitch underlies the first top stitch.

7. The method of claim 5 in which each of the lines of top and bottom threads extends between adjacent, parallel threads in the open weave material.

8. The method of claim 7 in which the lines of top and bottom stitches are adjacent, the holes between which extend the top stitches of one line being other than immediately adjacent the holes between which extend the top stitches of the adjacent line.

9. The method of claim 1 in which the first and second holes between which extend the bottom stitches are different from the first and second holes between which extend the top stitches, at least one of the first and second holes of each of the top stitches lying between the first and second holes of the adjacent top stitch.

10. The method of claim 1 in which the first and second holes of at least one of the top stitches are adjacent holes of the open weave material.

11. A canvaswork article which comprises:

an open weave material defining several holes and having a first, top surface and a second, bottom surface; and several adjacent lines of stitches, each line of stitches including a top line of stitches having several endways-adjacent top stitches, each of the top stitches extending from a first hole in the open weave material to a second hole in the open weave material, the first and second holes of at least two of the top stitches having at least one hole in the open weave material lying therebetween;

each line of stitches further includes a bottom line of stitches having several endways-adjacent bottom stitches, the bottom line of stitches directly underlying the top line of stitches, the first and second holes of at least two of the bottom stitches having at least one hole in the open weave material lying therebetween.

12. The article of claim 11 in which one of the lines of stitches includes bottom stitches directly underlying respective ones of the top stitches, the holes between which extends a top stitch being identical with the holes between which extends the respective bottom stitch.

13. The article of claim 11 in which for at least one of the lines of stitches the first and second holes between which extend the bottom stitches are different from the first and second holes between which extend the top stitches, at least one of the first and second holes of each of the top stitches of the line of stitches lying between the first and second holes of the adjacent top stitch in the line of stitches.

14. The article of claim 11 in which for at least one of the several lines of stitches the first and second holes of at least one of the top stitches are adjacent holes of the open weave material.

15. The article of claim 11 in which for at least two adjacent lines of stitches the holes between which extend the top stitches of one of the two lines of stitches are other than immediately adjacent the holes between which extend the top stitches of the other of the two lines of stitches.

* * * * *